United States Patent [19]

Kruger et al.

[11] 4,427,983

[45] Jan. 24, 1984

[54] LOSSLESS ANNULAR ROTARY RF COUPLER

[75] Inventors: Bradford E. Kruger; John C. Parr, both of Woodland Hills, Calif.

[73] Assignee: International Telephone & Telegraph Corporation, New York, N.Y.

[21] Appl. No.: 334,231

[22] Filed: Dec. 24, 1981

[51] Int. Cl.[3] ..... H01Q 3/02

[52] U.S. Cl. ..... 343/763; 333/261

[58] Field of Search ..... 343/762, 763; 333/261

[56] References Cited

U.S. PATENT DOCUMENTS 3,546,699 12/1970 Smith ..... 343/762

4,222,055 9/1980 Hockham et al. ..... 333/261

*Primary Examiner*—Eli Lieberman

*Attorney, Agent, or Firm*—T. E. Kristofferson; W. T. O'Neil

[57] ABSTRACT

An annular rotary RF coupler for installation about a vertical support structure, such as the mast of a ship. Two annuli are divided into circumferential increments providing a cellular structure of individual waveguide cross-sections. A lower annulus (stator) remains fixed, the individual waveguide sections therein being fed from a power-divided, equal-phase, feed configuration. The oppositely facing upper annulus (rotor) rotates with respect to the lower one about the common mechanical center of rotation of a mechanically rotating antenna system. Connection to the rotating waveguide sections may be through power combiner/divider means, or individual subarrays may be discretely connected to one or more waveguide sections in the rotating annulus. For power tapering across an antenna array aperture, the waveguide section dimensions in the circumferential direction within the rotating annulus are appropriately tailored. A single enlarged stator cell is employed to accept the residual energy in the power distribution transmission line, eliminating the need for a termination load and the corresponding power loss.

7 Claims, 7 Drawing Figures

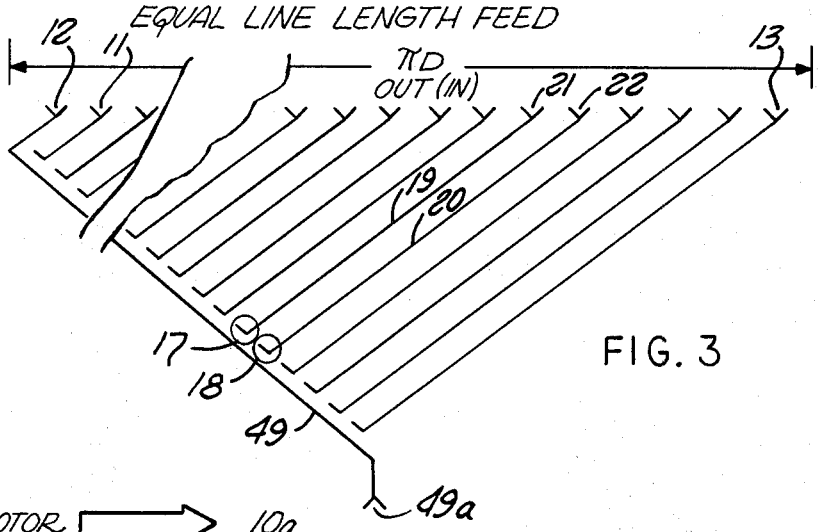
FIG. 3
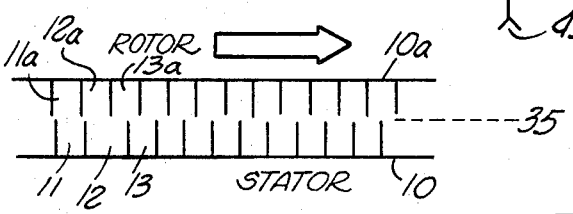
FIG. 4
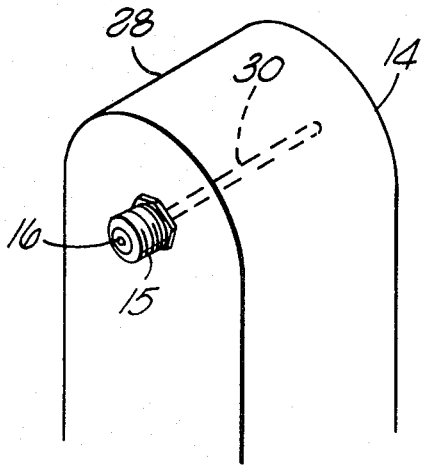
FIG. 5
FIG.6
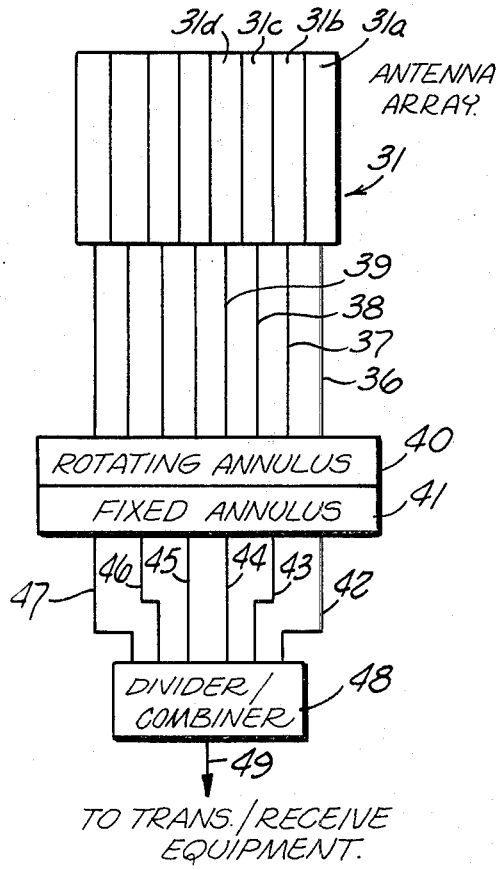

LOSSLESS ANNULAR ROTARY RF COUPLER

BACKGROUND OF THE INVENTION

1. Field of the Invention

The invention relates to radar antenna systems and, more particularly, to rotating RF couplings to accommodate antenna mechanical rotation.

2. Description of the Prior Art

In the prior art, rotating RF couplings have been provided in a number of forms. A brief summary of these devices is contained in the test Radar Handbook by Merrill I. Skolnik (McGraw-Hill 1970) in Chapter 8 under a paragraph entitled "Rotary Joints." Bibliographical references concerning the theory and design of rotary joints are included with that summary.

The patent literature also includes description of prior art devices of conventional type, such as the apparatus of U.S. Pat. No. 2,751,559, for example.

In U.S. Pat. No. 3,896,446, a rotating RF joint is involved in a scanning radar system in which the antenna system is mounted over the top of a helicopter rotor to rotate with it; however, no advances in the rotary joint itself appear to be disclosed.

Other rotary RF joints, such as shown in U.S. Pat. No. 3,123,782 appear to be based on conductive circular ring arrangements and as such may be thought of as "slip-ring" devices.

Still further, systems not including sliding contacts but providing electromagnetic energy transfer in a rotating joint include multihorn configurations and the like. U.S. Pat. No. 3,803,619, and also U.S. Pat. Nos. 3,117,291 and 3,108,235 disclose devices of that type.

The slip-ring systems are known to suffer from arcing, mechanical wear, and other problems, and the rotating horn devices are complex and costly and leave much to be desired in energy transfer efficiency.

In the most familar shipboard rotating antenna installations, lateral structural members affixed to mast structures have been required to provide horizontal clearance for a rotating antenna system. Prior art rotary joints of the aforementioned and other conventional types have been applied in such instances. Many have used such expedients as circular waveguide, coaxial transmission line sections and the like providing rotatable conductive walls essentially concentric with the axis of rotation of the antenna structure itself.

A device is described in U.S. Pat. No. 4,222,055 (assigned to the assignee of this application) utilizes a pair of facing annular ring-like subassemblies each divided into cells producing a series of circumferentially disposed open-ended, facing, waveguide sections. The cross-sections of these waveguides are in planes normal to the common axis of the two annular subassemblies. One of these rings is fixed (stator) and the other rotates (rotor) in a fixed mechanical relationship with a rotating antenna array. The interface between rotor and stator facilitates energy transfer, the stator waveguide cells all being dimensionally equal and equally excited to provide a uniform energy distribution pattern over the circumference of the interface.

It is also pointed out in U.S. Pat. No. 4,222,055 that a taper of excitation applied to the driven array elements or columns of elements can be provided by variation of rotor cell sizes.

In the course of providing the desired circumferentially uniform excitation at the rotor/stator interface, the device of the aforementioned U.S. Pat. No. 4,222,055 employs a predetermined number of waveguide cells N, each having a circumferential dimension $\theta$, where $\theta = 360/N$. Each cell is fed from a transmission line tap, the line being fed at one end from a source (transmitter, etc.) and terminated in a resistive load at its other end.

The termination load acts to absorb power not taken by the taps, and furthermore it can be shown that some power will always be committed to the load. A direct connection to a "last" stator cell is possible, but in the configuration contemplated in the aforementioned U.S. Pat. No. 4,222,055, the power supplied to this last cell would be unequal to that extant in the remaining cells, electric field non-uniformity at the rotor/stator interface resulting. The uniformity of the circumferential electric field at the rotor/stator interface is important and in view of that, the load terminated line was employed in this prior art configuration. The use of a 3 db coupler at the "last" stator cell is theoretically possible to avoid use of the load; however, the implementation of a 3 db coupler has been found to be technically unrealizable.

A typical prior art arrangement comprised twenty stator cells each taking approximately 4.65% of the total line input power, the remaining 7% of the power being absorbed in the termination.

The obvious loss of power efficiency accepted for the sake of circumferential uniformity of the electric field at the rotor/stator interface is undesirable, and the manner in which this loss is eliminated according to the invention will be understood as this description proceeds.

SUMMARY OF THE INVENTION

In accordance with the aforementioned prior art discussion, it may be said to have been the general objective of the present invention to produce a high efficiency (substantially lossless) rotating annular radio-frequency coupler.

The invention is based on the technical fact that, in a distributive transmission line feed arrangement exciting the individual cells (open end waveguide sections) of one of the two interfaced annulus subassemblies, one or more of the cells can be modified in cross-sectional area so that it can accommodate excitation differing from that of the other cells while still preserving the electric field uniformity over the interface.

In a typical embodiment of the invention, a twenty-first cell was added among the twenty cells contemplated in the prior art. This twenty-first cell is enlarged in its circumferential dimension while maintaining its radial dimension equal to that of the other cells, so that the larger fraction of the total excitation provided thereto effects the same electric field density at the interface (since this larger excitation in the twenty-first cell is distributed over a larger cell).

The details of a typical and representative embodiment according to the invention, including related structure for the practice of the invention, will be presented hereinafter.

BRIEF DESCRIPTION OF THE DRAWINGS

FIG. 3 is a schematic diagram of an equal-path feed arrangement applicable to a system employing the invention.

FIG. 4 is a cross-sectional representation through a portion of FIG. 1 as indicated.

FIG. 5 depicts a typical coaxial-to-waveguide transition applicable to the arrangement of FIG. 1.

FIG. 6 is a schematic block diagram illustrating a form of integral combiner/divider feed according to either the prior art or into which the present invention may be advantageously incorporated.

DETAILED DESCRIPTION

Figure 1:
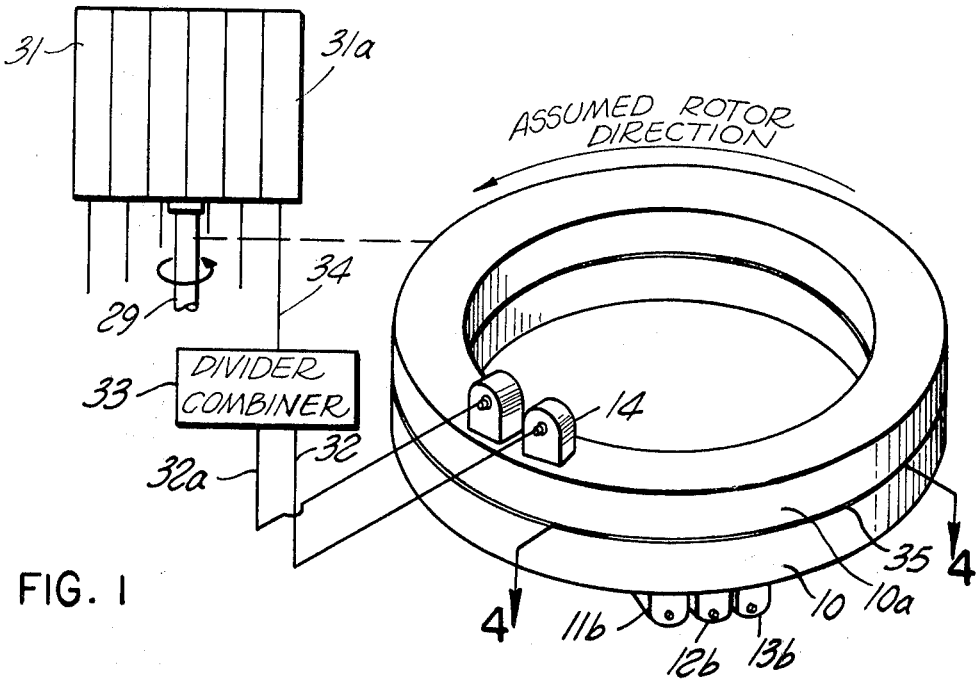
FIG. 1 depicts rotor and stator annulus subassemblies interfaced with associated antenna array and feed interconnections, all in a partially pictorial representation according to the invention or the prior art.

Referring now to FIG. 1, an assembly of rotor and stator annular subassemblies is shown connected to a typical antenna array 31. The annular interface occurs at 35, between the stator subassembly 10, which is fixed and normally connected by means of other apparatus to a transmit/receive equipment location. The rotor portion 10*a* rotates about the common center it has with the stator 10 and it should be understood that a mast or other vertical support structure normally passes through the open circular center space within 10 and 10*a*. In the prior art, an array such as 31 would typically be mounted with conventional mechanical rotational drive at the top of such a mast, this drive also effecting rotation of the annulus subassembly 10*a* synchronously with the rotation of array 31, i.e., 10*a* would be mechanically fixed to common rotating parts associated with the antenna array shaft 29. Those details are entirely conventional, of course.

The known advantages of the annular rotary RF joint per se are discussed in the prior art hereabove identified, and those same advantages accrue to a system employing the invention, along with the additional advantage achieved through the invention. Further description of the remaining elements depicted in FIG. 1 will be given in connection with description of the other figures herewith, in order that the nature of the annular subassemblies 10 and 10*a* can first be described.

Figure 2A:
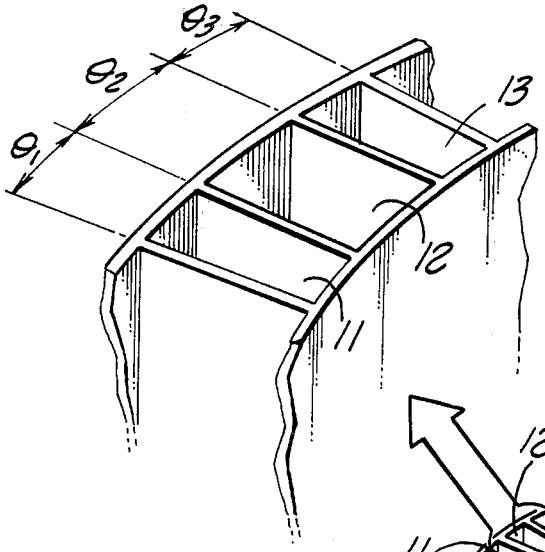
FIG. 2*a* is a magnified view of a portion of FIG. 2.
Figure 2:
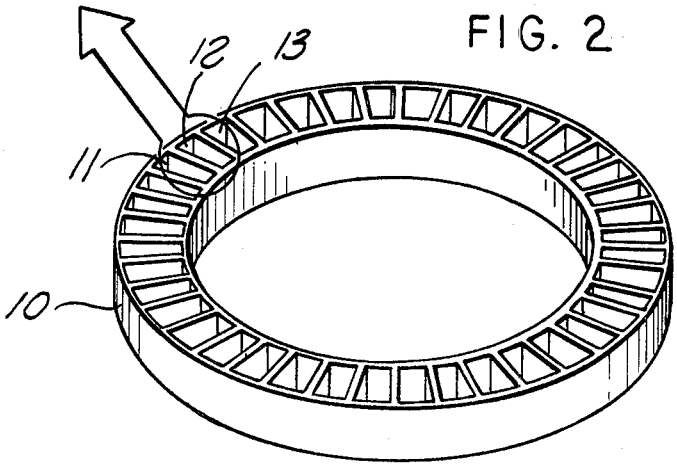
FIG. 2 is a representation of the stator subassembly of FIG. 1 in a particular form applicable to the present invention.

Referring now to FIG. 2, stator 10 is depicted independently with 10*a* removed. It will be seen that the annulus is divided into individual waveguide cells or sections, typically 11, 12 and 13. In one typical embodiment according to the invention, twenty-one such cells were included. The prior art configuration contemplated twenty identical cells such as 11 and 13, each corresponding to an arc of circumference ($\theta_1$ or $\theta_3$) of 18°. On the other hand, according to the invention, an extra cell 12 of larger circumferential dimension $\theta_2$ is included. Referring back to the prior art twenty cell typical stator annulus, it is noted that approximately seven percent (7%) of the excitation power was dissipated in a termination load at the end of a distribution transmission line such as 49 (FIG. 3) from which discrete taps were arranged to feed the individual stator cells. Essentially, by increasing $\theta_2$ in the said twenty-first cell identified as 12 in FIGS. 2 and 2*a*, the end of the distribution transmission line can be directly fed thereto.

In the typical prior art situation, the ninty-three percent (93%) usable power was divided between the aforementioned twenty cells, providing 4.65% power in each cell. If the additional or twenty-first cell had a circumferential width of $\theta_2$ equal to $(7/4.65)\times\theta_1$ or $\theta_3$, then it will be realized that the power in each cell including the enlarged twenty-first cell would be proportional to the angular width thereof. Stated otherwise, the power in each cell would be proportional to the equivalent area of the mouth of each cell at the interface plane. It will further be realized at this point that the electric fields in all the cells would have the same density per unit area.

Looking at FIG. 5, the coaxial line-to-waveguide transitions identified on FIG. 1 as 14, typically for the rotor, and 11*b*, 12*b* and 13*b*, typically for the stator, are as depicted in FIG. 5. A probe 30 extends within a cavity enclosure 14 formed by the extension of each corresponding waveguide cell externally will be recognized as a standard coaxial-to-waveguide transition by those of skill in this art. The coaxial connector having an outside conductor sleeve 15 connects to the conductive wall of the transition device 14 and probe 30 is connected via the connector center conductor 16 to the center conductor of the distribution line 49 (illustrated in FIG. 3). The domed portion of the transition device 14 at 28 is conventional and will be immediately understood by those of skill in this art.

Referring now to FIG. 3, a development of the feed ports for the entire circumference of the stator annulus 10 is shown. The so-called twenty-first enlarged cell fed from port 12*b* is shown in FIG. 3 to be connected to the end of the transmission line 49 and the others are appropriately connected from taps such as 17 and 18. It will be realized that the circumferential ports depicted in FIG. 3 such as 11*b*, 12*b* and 13*b* as well as 21 and 22 (not correspondingly illustrated on FIG. 1) must necessarily be excited in phase. Accordingly, the arrangement of FIG. 3 provides for equal-path between the common port 49*a* and each of the circumferential ports. Thus, that portion of the line 49 between 49*a* and 18 plus line 20 must equal the length of 49 between 49*a* and 17 plus 19. The same applies to all the other circumferential ports including 11*b*, 12*b* and 13*b*. It will be realized, of course, that each cell as seen in FIG. 2 has a corresponding circumferential port although, for simplicity, the illustration of all such ports has been omitted from FIG. 1. The same applies to the rotor ports 11*a*, 12*a* and 13*a* (from FIG. 4), only two of which have been illustrated in FIG. 1 for simplicity.

It is the common port 49*a* which constitutes the connection of the system to transmit/receive apparatus of conventional type.

In FIG. 1, the rotor connections from 11*a* and 12*a* via leads 32 and 32*a* into divider/combiner 33 and thence by a lead 34 to a column 31*a* of the array 31 apply to the situation in which more cells of the rotor annulus are extant in 10*a* (for example, twice as many) as compared to the number of columns of array element such as 31*a*. Of course, in that situation each of the other columns of elements in array 31 would be similarly connected through a discrete combiner/divider to other elements equivalent to 11*a* and 12*a* progressing around the rotor annulus 10*a*. The divider/combiner 33 is an entirely conventional device well understood by those of skill in this art.

The cutaway view of FIG. 4 showing rotor and stator cells according to the sectioning line in FIG. 1 illustrates the fact that there is no fixed relationship required between the number of cells in the rotor as compared to the number of stator cells employed. The cells 11*a*, 12*a* and 13*a* of the rotor may, for example, be smaller or larger than any cell in the stator 10. The uniform electric field generated across the interface 35 permits a smooth energy transfer during relative rotation of rotor and stator notwithstanding cell configuration differences between rotor and stator. It should be pointed out that for purposes of providing an excitation taper to the array 31, rotor cells may be reduced in circumferential width where they correspond to outside columns of elements of the array 31. Excitation taper, such as frequently employed for the reduction of grating lobes in the array radiation pattern, is thereby achieved without further circuitry.

Referring now to FIG. 6, a block diagram of an arrangement including one-to-one correspondence between the number of cells in a rotating annulus 40 and the number of columns of array elements in array 31 is presented. A discrete cell of rotor 40 connects to each of the lines 36, 37, 38 and 39, corresponding respectively to antenna element columns 31*a*, 31*b*, 31*c* and 31*d*.

Again, an unequal number of stator excitation lines 42, 43, 44, 45, 46 and 47 leading from a divider/combiner 48 to discrete corresponding cells of fixed annulus 41 further illustrates the fact that the combination of the rotating and fixed annulus (rotor and stator) implementation is capable of providing an inherent power division and combination function. The divider/combiner 48 may be thought of as electrically equivalent to the tapped line arrangement of FIG. 3.

It will now be realized that the objective of the invention has been achieved in that the inherent power loss encountered in the prior art apparatus identified has been eliminated thereby providing an inherently more efficient device otherwise providing all the advantages and functions achieved previously.

Various modifications will suggest themselves to those of skill in this art and, accordingly, it is not intended that the drawings or this description should be considered as limiting the scope of the invention. The drawings and this description are intended to be typical and illustrative only.

What is claimed is:

1. A rotary, annular, radio-frequency coupler system having rotor and stator members each including a contiguous series of spaced conductive webs extending radially between inner and outer concentric conductive cylindrical surfaces to divide said rotor and stator members each into a series of cells, said rotor and stator members each being open and facing each other at an annular planar interface, said rotor and stator being arranged concentrically and having said inner cylindrical surfaces of each of the same diameter and said outer cylindrical surfaces of each of the same diameter, thereby forming an annular interface for transfer of radio-frequency energy between said rotor and said stator, and comprising:

first means including a transmission line having a common port at a first end and distributed taps along said line, said taps each feeding a discrete connecting line to a corresponding one of said stator substantially equal interface area first cells, said taps each providing a predetermined fraction of the energy at said tapped line input, the sum of the energies at said taps being less than at said common port;

a single second cell among said first cells and second means discretely connecting the second end of said tapped line to said second cell, said second cell having interface area adjusted to compensate for the differing energy at said tapped line second end as compared to the energy at each of said first cells, thereby to afford circumferentially uniform energy density at said interface.

2. The rotary coupler system according to claim 1 in which said second means is constructed to provide a second cell interface area $A_2$ which is equal to $KA_1$, where $A_1$ is the interface area of each of said first cells and K is the ratio of the energy present at said tapped transmission line second end to the energy present at each of said first cells.

3. The rotary coupler system according to claim 2 in which said second means is constructed such that $K>1$ and said second cell interface area is therefore greater than the area of each of said first cells.

4. A rotary coupler system according to claim 1, 2 or 3 in which said conductive webs form the broad walls of the waveguide sections corresponding at least to each of said first cells.

5. A rotary coupler system according to claim 1, 2 or 3 in which said conductive webs form the broad walls of the waveguide sections of each of said cells.

6. A rotary coupler system according to claims 1, 2 or 3, including an antenna array and in which said rotor cells are each connected to a corresponding element or column of elements of said antenna array.

7. A rotary coupler system according to claims 1, 2 or 3, including an antenna array and in which combiner/divider means are included whereby a plurality of cells of said rotor are connected to each corresponding element or column of elements of said antenna array.

* * * * *